US007806151B2

(12) United States Patent
Hennen et al.

(10) Patent No.: US 7,806,151 B2
(45) Date of Patent: Oct. 5, 2010

(54) DRUM CAP VENTING DEVICE

(75) Inventors: John M. Hennen, Carver, MN (US); Jeffrey J. McKenzie, Watertown, MN (US)

(73) Assignee: Entegris, Inc., Billerica, MA (US)

( * ) Notice: Subject to any disclaimer, the term of this patent is extended or adjusted under 35 U.S.C. 154(b) by 320 days.

(21) Appl. No.: 11/397,333

(22) Filed: Apr. 4, 2006

(65) Prior Publication Data

US 2006/0225812 A1 Oct. 12, 2006

Related U.S. Application Data

(60) Provisional application No. 60/669,946, filed on Apr. 8, 2005.

(51) Int. Cl.
*B65B 31/04* (2006.01)

(52) U.S. Cl. ..... 141/65; 141/367

(58) Field of Classification Search ..... 141/65, 141/351, 367
See application file for complete search history.

(56) References Cited

U.S. PATENT DOCUMENTS

| | | | | |
|---|---|---|---|---|
| 3,599,843 | A | 8/1971 | Johnston | |
| 4,134,522 | A | 1/1979 | Patzke et al. | |
| 4,231,489 | A | 11/1980 | Malone | |
| 4,687,122 | A | 8/1987 | Bothun et al. | |
| 4,688,591 | A | 8/1987 | Edson | |
| 4,699,298 | A * | 10/1987 | Grant et al. | 222/400.7 |
| 4,832,237 | A | 5/1989 | Hurford, Jr. | |
| 4,929,293 | A | 5/1990 | Osgar | |
| 4,984,717 | A | 1/1991 | Burton | |
| 5,108,015 | A | 4/1992 | Rauworth et al. | |
| 5,121,057 | A | 6/1992 | Huber et al. | |
| 5,193,709 | A * | 3/1993 | Brassell | 220/371 |
| 5,526,956 | A | 6/1996 | Osgar | |
| 5,597,085 | A | 1/1997 | Rauworth et al. | |
| 5,636,769 | A | 6/1997 | Willingham | |
| 5,875,921 | A | 3/1999 | Osgar et al. | |
| 5,957,328 | A | 9/1999 | Osgar | |
| 5,992,475 | A * | 11/1999 | Campbell | 141/65 |
| 6,045,000 | A * | 4/2000 | Rauworth et al. | 220/601 |
| 6,045,012 | A | 4/2000 | Hansen | |
| 6,079,597 | A | 6/2000 | Rauworth et al. | |
| 6,196,522 | B1 | 3/2001 | Yuen et al. | |
| 6,439,433 | B1 | 8/2002 | Dubach et al. | |

(Continued)

FOREIGN PATENT DOCUMENTS

| | | |
|---|---|---|
| EP | 0 283 647 A1 | 1/1988 |

*Primary Examiner*—Timothy L Maust
*Assistant Examiner*—William McCalister
(74) *Attorney, Agent, or Firm*—Patterson, Thuente, Skaar & Christensen, P.A.

(57) ABSTRACT

The drum cap venting device generally includes a venting cap assembly. The venting cap assembly can include a venting cap and a venting key. The venting cap generally includes a main body portion, a valve portion and a ring portion. The venting key generally includes a key body portion and a venting tube. The venting key is rotatably engageable with the valve portion of the venting cap such that rotation of the key provides a passageway of continuous fluid communication from the drum, through conduits in the venting cap, and out the venting tube of the venting key. As a result, any release or evacuation of pressurized gasses from the drum is directed away from the user to a safe area or device.

7 Claims, 5 Drawing Sheets

U.S. PATENT DOCUMENTS

| | | | | |
|---|---|---|---|---|
| 6,523,861 | B1 | 2/2003 | Clancy et al. | |
| 6,543,654 | B1 | 4/2003 | Uhl et al. | |
| 6,554,019 | B1 | 4/2003 | Grittmann | |
| 6,739,577 | B2 | 5/2004 | Clancy et al. | |
| 2002/0000451 | A1 | 1/2002 | Hansen | |
| 2002/0179157 | A1* | 12/2002 | Rokkjaer | 137/588 |
| 2003/0010387 | A1 | 1/2003 | Rauworth et al. | |
| 2004/0140308 | A1 | 7/2004 | Maenke | |

* cited by examiner

DRUM CAP VENTING DEVICE

RELATED APPLICATION

The present application claims the benefit of U.S. Provisional Application No. 60/669,946, filed Apr. 8, 2005, which is incorporated herein in its entirety by reference.

FIELD OF THE INVENTION

This invention relates generally to fluid dispensing systems. More particularly, the invention relates to a bung cap device having a venting mechanism for evacuating pressurized fluid from a dispensing container.

BACKGROUND OF THE INVENTION

In industries such as semiconductor processing, pharmaceutical and chemical manufacturing, high purity, highly corrosive or highly caustic liquids are utilized. Due to safety and quality considerations, these liquids must be contained in containers and dispensing systems of high reliability and integrity. The connections, tubing, and fittings for handling these fluids must be formed from highly inert materials. Fluoropolymers have been found to be suitable for use in these environments. The tubing can be formed of PFA, the fittings, valve components and dispense heads may be formed of components such as PFA and PTFE, and other fluoropolymers. Containers for handling these liquids are typically plastic drums formed of high purity polyethylene such as those disclosed in U.S. Pat. No. 6,045,000, which is hereby incorporated by reference. The drums will conventionally have a bung opening with a drum insert that includes a down tubing portion connecting to an upward and concentric nipple of the bung. A dispense head couples with the drum insert and has a main fluid passageway that connects to and sealingly engages the nipple for dispensing fluid from the drum.

When transporting or storing the drums, conventional caps or plugs are placed over or in the bung opening of the drum. Various factors can cause pressure to build up within the drum during transportation and storage. These factors can include the type of fluids/materials stored within the drum, the time of storage, altitude and temperature changes, transporting activities, and the like. For instance, ammonia hydroxide and peroxide are commonly stored and transported fluids that often cause pressure to build up in drums. When the cap is eventually removed from a pressurized drum to connect the dispense head to the drum prior to use, gasses or even the stored liquid itself can be discharged out of the bung opening, posing a very serious safety threat to those in proximity of the drum.

Venting systems have been developed in an attempt to address these pressure-related concerns. Namely, various vent connection ports and valves have been added to the drum fittings or drum closures to vent the internal drum pressure. Examples of such systems are disclosed in previously incorporated U.S. Pat. No. 6,045,000. However, such conventional venting techniques do not incorporate the designs and mechanisms required to ensure evacuation or venting of the pressurized gas to a safe area. Accordingly, a storage and transporting drum cap is needed that will address the dangers and concerns inherent with pressure buildup within conventional fluid storage and dispensing drums.

SUMMARY OF THE INVENTION

A fluid dispensing system generally includes a drum with a bung, a drum insert that includes a downtube that inserts into the bung, and a dispense head that couples with the drum insert to provide dispensing access to the fluids in the drum. To facilitate shipment and/or storage of the drum and its contents, the dispense head can be removed. In these circumstances, a cap is threadably engaged with the bung opening or the drum insert to close off the bung opening.

The drum cap venting device in accordance with the present invention generally includes a venting cap assembly. The venting cap assembly can include a venting cap and a venting key. The venting cap generally includes a main body portion, a valve portion and a ring portion. The venting key generally includes a key body portion and a venting tube. The venting key is rotatably engageable with the valve portion of the venting cap such that rotation of the key provides a passageway of continuous fluid communication from the drum, through conduits in the venting cap, and out the venting tube of the venting key. As a result, any release or evacuation of pressurized gasses from the drum can be directed away from the user to a safe area or device.

A feature and advantage of embodiments of the invention is that the drum cap venting device ensures safe evacuation of pressurized fluid to a safe location. Undesirable spraying of gasses and liquid from an opening in the drum is avoided upon opening.

A feature and advantage of embodiments of the invention is that a combination of the venting cap and venting key components ensure proper evacuation of fluids from the drum. As such, unsafe evacuation of fluid from the drum is avoided.

A feature and advantage of embodiments of the invention is that the venting cap device can be constructed of various thermopolymers, such as PE, PFA, PTFE and the like.

A feature and advantage of embodiments of the invention is that the venting key can be separately retained by the end user such that when the drum and venting cap arrive, selective venting can take place. As a result, venting can take place at facilities having appropriate safe venting environments or devices.

A feature and advantage of embodiments of the invention is that the venting valve assembly can be self-contained within the shipping and storage cap.

A feature and advantage of embodiments of the invention is that the user can use the venting cap on various drums rather than relying upon unique integrated venting mechanisms for each drum. As such, only those drums containing chemicals or material requiring venting need use the venting cap device.

DETAILED DESCRIPTION OF THE DRAWINGS

Figure 1:
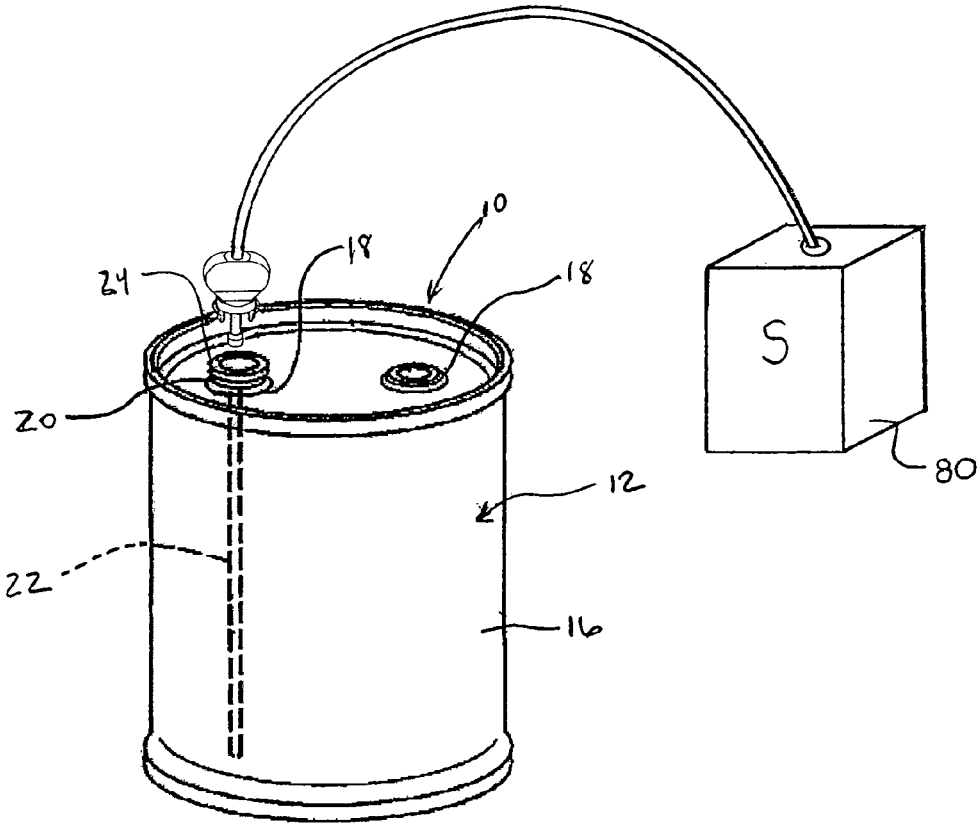
FIG. 1 is a perspective view of a fluid dispensing drum and venting device, with a venting tube routed to a scrubber in accordance with an embodiment of the present invention.
Figure 2:
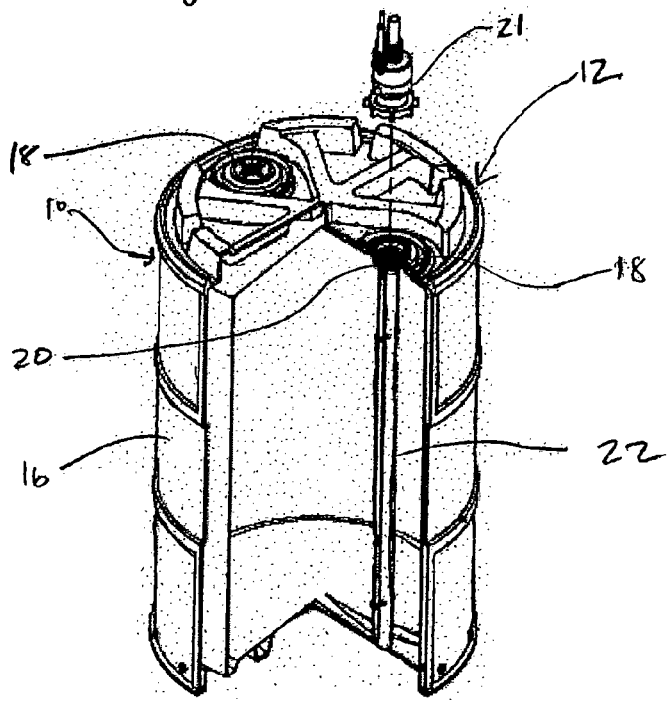
FIG. 2 is a cut away perspective view of a fluid dispensing drum, drum insert and dispense head for use in accordance with an embodiment of the present invention.
Figure 3:
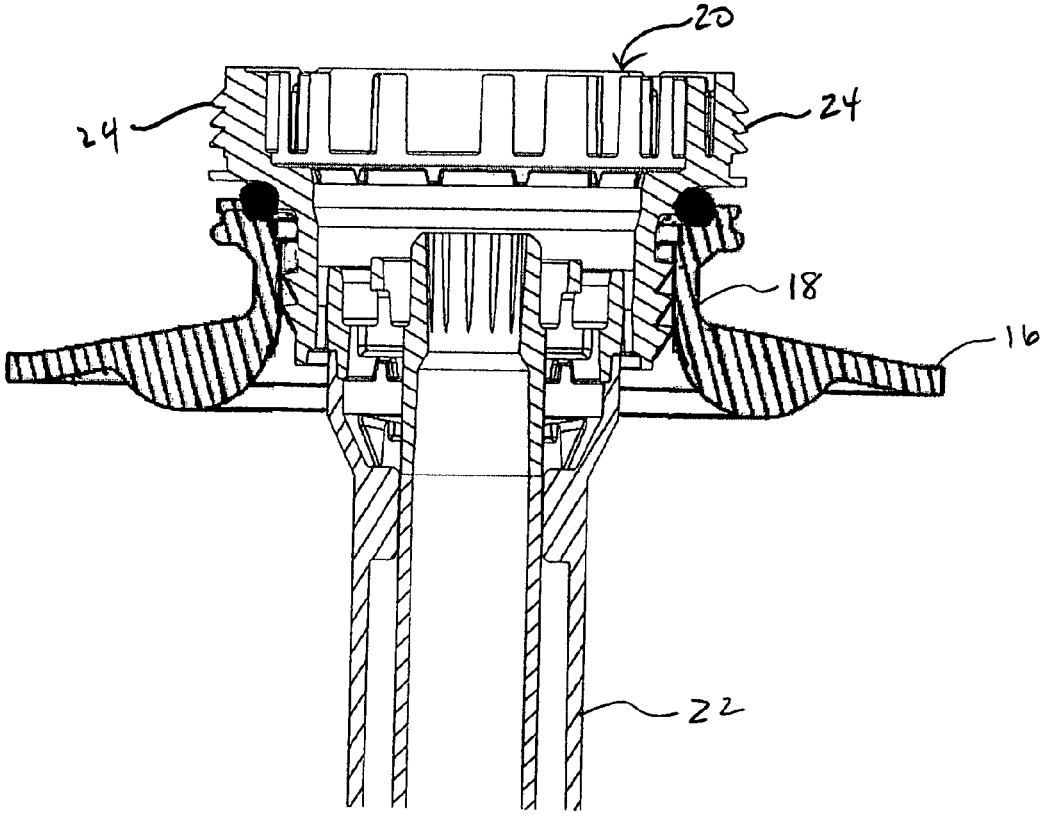
FIG. 3 is a cross-sectional view of a drum insert engaged with a drum bung opening for use in accordance with an embodiment of the present invention.

Referring generally to FIGS. 1-8, a fluid container venting system 10 is depicted. The venting system 10 generally includes a drum 12 and a venting cap assembly 14. As shown in FIGS. 1-3, the drum 12 can include a container housing 16, at least one bung or access opening 18 and a drum insert 20. The drum insert 20 includes a downtube portion 22 and at least one upper threaded portion 24. The drum 12 can be constructed of multiple layers, such as from polymers formed in a blow molding process, and can include various internal bags/membranes or lining portions. While in one embodiment the drum 12 is constructed of polyethylene, a myriad of other materials are also envisioned. The at least one bung opening 18 is defined generally in a top portion of the drum 12 and the drum insert 20 is adapted to couple with the bung 18, as depicted in FIGS. 1-3. Further, various dispense heads 21 and other fittings can be coupled to the drum insert 20 and/or the bung 18 to facilitate the dispensing of fluids from, and the recirculation of fluids into the drum 12. Examples of drums, inserts, dispense heads and other fittings and components that can be employed with the present invention are disclosed in U.S. Patent Publication No. 20030010387A1, and U.S. Pat. Nos. 4,699,298, 5,108,015, 5,526,956, and 5,957,328, each of which is incorporated herein by reference.

Referring primarily to FIGS. 4-7, the venting cap assembly 14 is shown. The venting cap assembly 14 can include a venting cap 26 and a venting key 28. The venting cap 26 generally includes a main body portion 30, a valve portion 32 and a ring portion 34. In one embodiment, the venting cap 26 components are distinct and assemblable to construct the venting cap 26, as particularly shown in FIG. 4. However, in other embodiments one or more of the components may be integrally formed or otherwise coupled. The venting cap 26 can be constructed of various materials, such as PFA, PTFE, PE or a myriad of other polymers and known materials.

Figure 6:
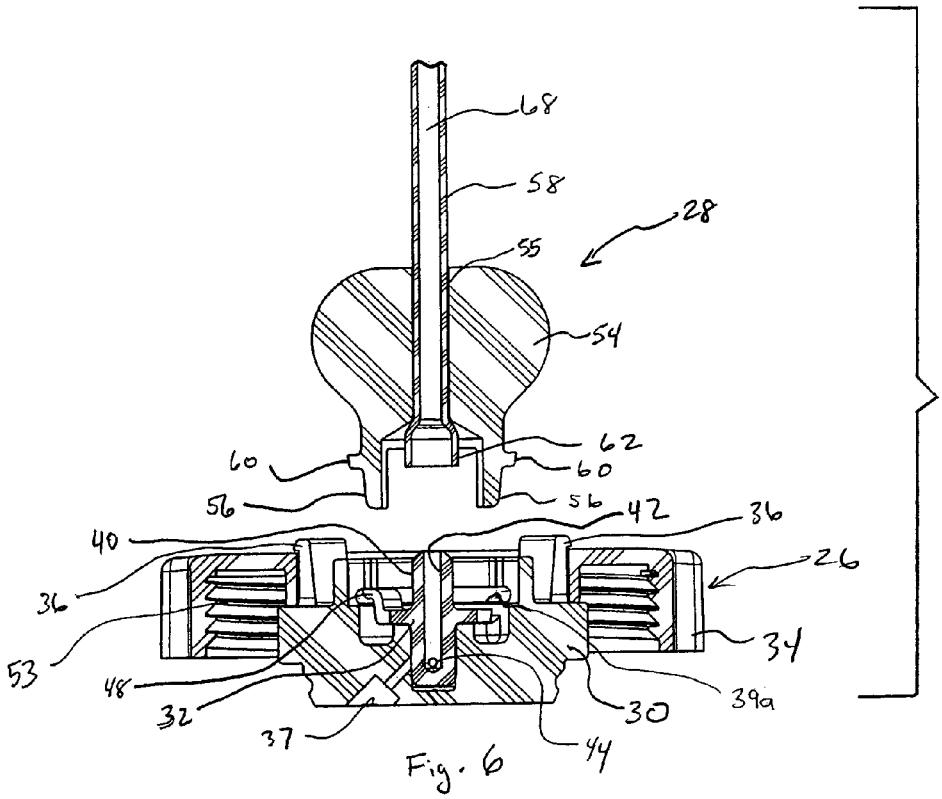
FIG. 6 is an exploded cross-sectional view of a drum cap venting device in a closed position in accordance with an embodiment of the present invention.
Figure 7:
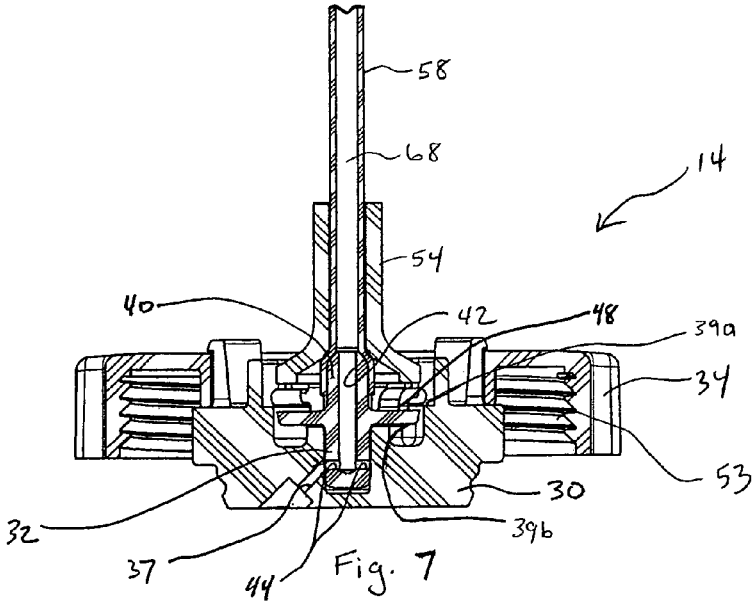
FIG. 7 is a cross-sectional view of a drum cap venting device in an open position in accordance with an embodiment of the present invention.

The main body portion 30 of the venting cap 26 includes an insertion portion 35, at least one engagement tab 36, a main body conduit 37 and a valve recess portion 38. The insertion portion 35 is adapted to couple the cap 26 to the drum insert 20, or other structure of the drum 12, to seal off the at least one bung opening 18. For instance, the insertion portion 35 of the cap 26 can be threaded, adapted for pressure insertion, and the like. Other coupling techniques are also envisioned. The valve recess portion 38 can include a lip or groove portion 39*a*, and a slot or groove portion 39*b*. As shown in FIGS. 6-7, the main body conduit 37 can be angled and configured to terminate out through the main body portion 30 for fluid communication with the drum insert 20 or the interior of the drum 12.

The valve portion 32 includes a main vent member 40, a valve body ring 46, at least one engagement ear 48 and rotating slot portions 49. The main vent member 40 further includes a main valve conduit 42 generally along the longitudinal axis of the member 40, and a transverse valve conduit 44. The conduits 42, 44 are in fluid communication with each other through the vent member 40. In one embodiment, the transverse valve conduit 44 passes completely through side walls of the vent member 40, and is measurably smaller than, and generally perpendicular to the main valve conduit 42. The valve body ring 46 can be disposed around the vent member 40 with the engagement ears 48 extending out from the valve body ring 46. The rotating slot portions 49 can be slotted portions defined within the valve body ring 46 to engage a respective portion of the key 28 as described herein.

The ring portion 34 can include a ring aperture 50 defined therethrough, a gripping portion 52, and a threaded portion 53. The ring aperture 50 is generally sized to receive at least a portion of the key 28 and/or the main body portion 30. The gripping portion 52 can be defined along the periphery of the ring portion 34 to facilitate manual manipulation of the cap 26. In one embodiment, the gripping portion 52 is a series of spaced flats and indents. Other configurations and designs are also envisioned. The threaded portion 53 is generally provided within an interior section of the cap 26 and adapted for threadable coupling with corresponding threading on the opening 18 or threading 24 of the drum insert 20 (FIG. 3). Other threading or coupling configurations can be employed as well.

Figure 4:
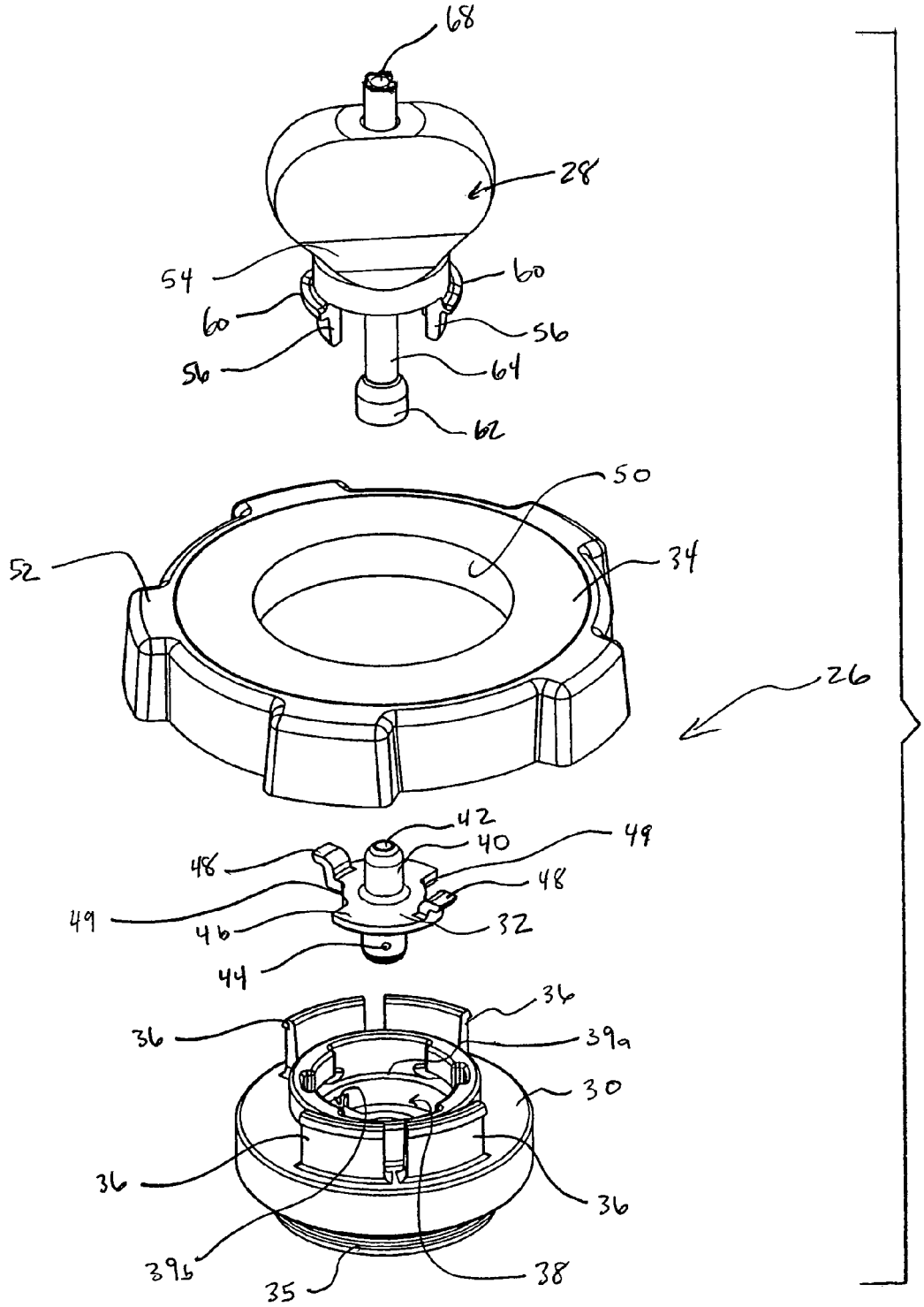
FIG. 4 is an exploded perspective view of a drum cap venting device in accordance with an embodiment of the present invention.

In one embodiment, the cap portions 30, 32, 34 are snappingly or fittingly engageable, or otherwise coupleable to create or assemble the venting cap 26, as shown in FIG. 4. For instance, in one embodiment, the valve portion 32 is secured within the valve recess 38 of the main body portion 30. As such, the valve body ring 46 is slidable along corresponding slot portions 39b of the main body 30 such that the two opposing engagement ears 48 ride along or within the lip portion 39*a*, of the main body 30. Rotatable displacement of the valve portion 32 within the main body portion 30 may be limited by abuttable engagement of the ears 48 against wall or stop positions within the valve recess portion 38 or other portions of the main body portion 30. Accordingly, rotation of the ears 48 can be limited to a rotational travel distance of 180 degrees or less. Other rotational displacement and travel configurations for the valve portion 32 and ears 48 can be employed without deviating from the spirit and scope of the present invention.

Figure 5:
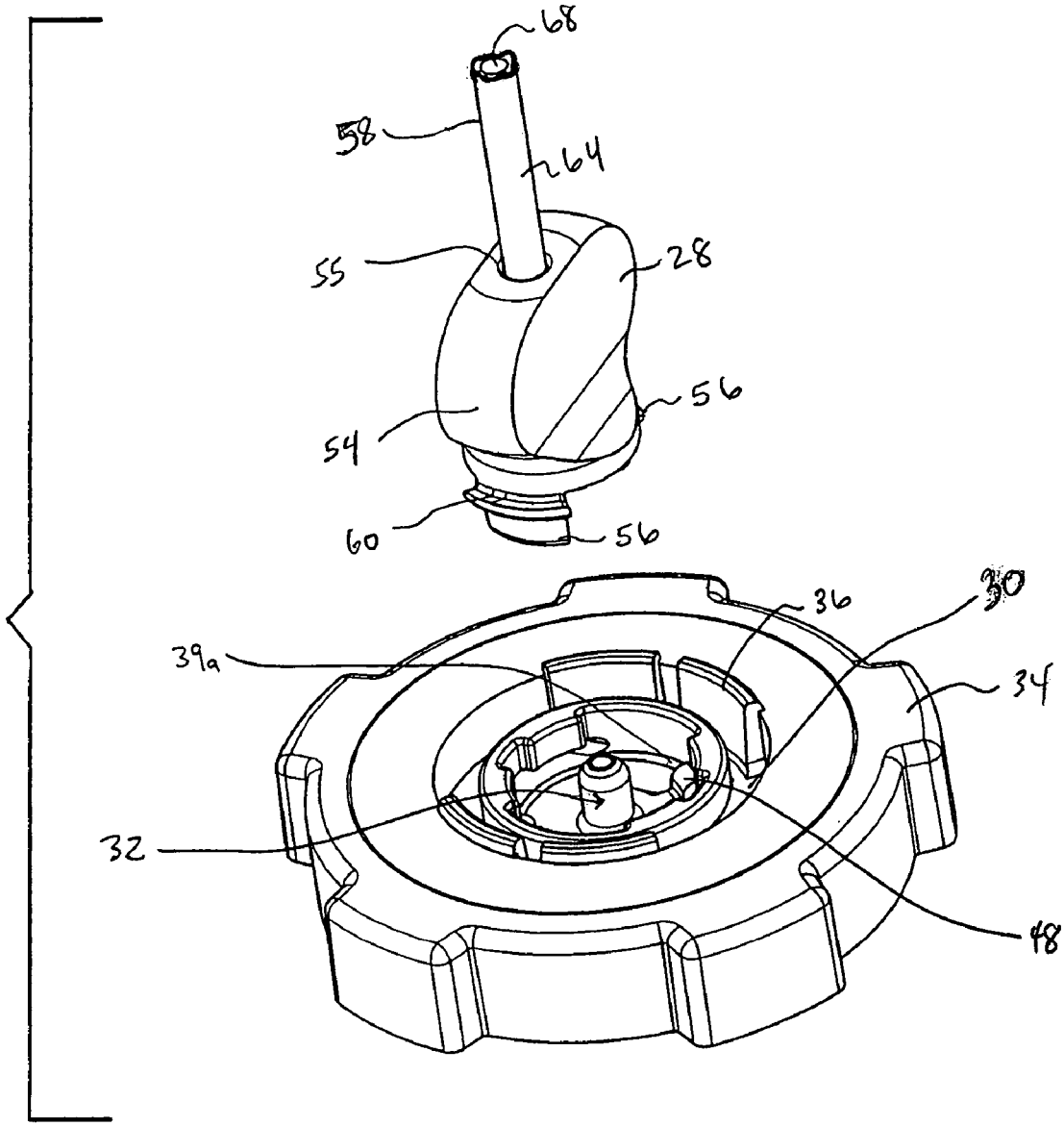
FIG. 5 is an exploded perspective view of a drum cap venting device in accordance with an embodiment of the present invention.

Referring generally to FIGS. 5-7, the engagement tabs 36 engage respective portions of the ring 34 proximate the ring aperture 50 to couple the ring 34 and main body portion 30 together. As a result, the assembled main body portion 30 and valve portion 32 are securely positioned within the ring aperture 50 such that the insertion portion 35 of the main body 30 extends down from the ring 34 for engagement with the drum insert 20. With such a configuration, the valve portion 32 can be independently rotated within the cap 26 and main body 30. It should be noted that various other attachment techniques and methods can be employed for coupling the various venting cap components 30, 32, 34. For instance, snap or pressure fittings, bonding techniques, molding techniques and a myriad of other known attachment techniques can be implemented as well.

In one embodiment, the venting key 28 is separate from the venting cap 26 and can include a key body portion 54, at least one engagement tab 56 and a venting tube 58. The key body portion 54 includes a bore 55 therethrough to receive the venting tube 58. The at least one engagement tab 56 can include a flange 60. The venting tube 58 can further include a first end portion 62, a tube body portion 64 and a tube conduit 68 therethrough. The first end portion 62 can be flared to slide over an end of the main vent member 40, as shown in FIGS. 6-7. As such, the conduits 42, 44 of the vent member 40 and the tube conduit 68 can be brought into fluid communication upon insertion of the key 28 into the cap 26. A second end of the venting tube 58 can extend out a distance from the venting cap assembly 14 for connection to various devices, or placement in various environments, as discussed further herein. In alternate embodiments, the venting tube 58 can be coupled to a portion of the key 28, such as the interior of the bore 55 or an exit portion of the bore 55, by way of bonding, fittings, adhesive, or various other known techniques and methods.

As shown in FIGS. 6-7, the venting key 28 can be inserted into the main body portion 30 of the venting cap to engage the valve portion 32. Specifically, in one embodiment, the venting key 28 includes two opposing engagement tabs 56 mateably alignable within the rotating slots 49 of the valve portion 32. With such a configuration, the flanges 60 generally rest on a surface of the valve body ring 46 to further provide secure engagement of the engagement tabs 56 with the value portion 32. As a result, rotation of the inserted and engaged key 28 causes the flanges 60 to force the valve portion 32 into corresponding rotational displacement. This rotational displacement, again, can be limited by start and stop positions of the ears 48 and ring 46 along portions of the valve recess 38 and/or the main body portion 30.

The rotation of the valve portion 32 and the corresponding main vent member 40 through rotation of the engaged venting key 28, likewise provides selective alignment of the transverse valve conduit 44 with the conduit 37 of the main body portion 30. In the generally closed position of FIG. 6, the transverse valve conduit 44 is not in fluid communication with the conduit 37 of the main body portion 30 such that fluids, such as pressurized gasses, within the drum 12 and drum insert 20 are fully contained therein. Removal of the venting cap 26 from the bung opening 18 at that point would release pressurized fluid contents of the drum 12 and potentially injure those in close proximity. To minimize such dangers, operation of the venting cap assembly 14 can serve to vent the pressurized fluids or gasses away from the drum 12 prior to removal of the cap 26.

To vent pressurized gasses within the drum 12 to a safe area (e.g., a scrubber device 80), the inserted key 28 is rotated within the valve portion 32. This rotation of the valve portion 32 and vent member 40 along a path of travel, correspondingly rotates the transverse valve conduit 44 into communication with the conduit 37 of the main body portion 30, as shown in FIG. 7. Consequently, an open valve position is achieved and continuous fluid communication is provided from the drum 12, through the body conduit 37, through the transverse valve conduit 44 and main valve conduit 42, and into and out of the tube conduit 68. This in turn provides a fluid communication path for the pressurized contents of the drum 12, and drum insert 20, out through a terminating end of the venting tube 58 to the safe venting area. By requiring engagement and rotation of the venting key 28 with the valve portion 32 before venting can occur, the present invention ensures that the pressurized fluids or gasses will be vented to the safe area, rather than at the cap itself as is the case with conventional venting mechanisms. Safe environments or areas can include isolated rooms, enclosures, and known devices such as scrubbers 80 (FIG. 1). A myriad of other areas and/or devices are envisioned for communication with an end of the venting tube 58 to provide a safe place for fluid evacuation.

The present invention may be embodied in other specific forms without departing from the spirit of any of the essential attributes thereof. Therefore, the illustrated embodiments should be considered in all respects as illustrative and not restrictive, reference being made to the appended claims rather than to the foregoing description to indicate the scope of the invention.

What is claimed is:

1. A method of evacuating pressurized gasses from a drum to a safe location prior to dispensing liquids therefrom, comprising:

providing a fluid containment drum having an access opening into an interior of the drum;

providing a drum insert to the fluid containment drum at the access opening, the drum insert including a downtube extending proximate the bottom of the drum, the downtube providing an upwardly extending nipple for connection of a fluid dispense head;

the fluid containment drum having a fluid therein capable of producing pressurized gas above the fluid in the fluid containment drum;

providing a drum cap to operably engage the access opening of the drum, the drum cap including a rotatable valve member with an open and closed positions, the valve member further including a rotatable valve conduit extending therethrough positioned to be in flow communication with the pressurized gas at the top of the fluid containment drum, the drum;

shipping the fluid containment drum from a first location to a second location with the valve member in a closed position;

providing a venting member at the second location, the venting member adapted to operably engage the drum cap and having a venting tube extending therefrom;

operably engaging the venting member with the drum cap, such that the venting tube is in operable engagement with the rotatable valve member, wherein operably enagaging the venting member with the drum cap includes engaging at least one corresponding engagement portion of the rotatable valve member;

opening the rotatable valve member of the drum cap such that a continuous gas passageway is opened from the pressurized gas in the interior of the drum, through the valve conduit, and out through the venting tube; and at said second location, evacuating the pressurized gas from the interior of the drum through the gas passageway to a safe location displaced from the access opening;

after the pressurized gas has been released, removing the drum cap; and installing a dispense head onto the drum connecting to the nipple for dispensing fluid from the drum.

2. The method of claim 1, wherein providing a venting member includes providing a venting key.

3. The method of claim 1, wherein operably engaging the venting member with the drum cap includes engaging at least one engagement tab of the venting member with the corresponding engagement portion of the rotatable valve member.

4. The method of claim 1, wherein the valve conduit of the rotatable valve member includes a first valve conduit extending longitudinally therethrough, and a second valve conduit extending transversely therethrough and in fluid communication with first valve conduit such that rotation of the valve member by the corresponding rotation of the engaged venting member brings the second valve conduit into operable fluid communication with the interior of the drum to provide the gas passageway to evacuate pressurized gas from the interior of the drum.

5. The method of claim 1, wherein providing the venting member includes providing a fluoropolymer venting member.

6. The method of claim 1, wherein providing the drum cap includes providing a fluoropolymer drum cap.

7. The method of claim 1, wherein providing the venting member includes providing the venting member with the venting tube having a second end portion terminating at the safe location.

* * * * *

UNITED STATES PATENT AND TRADEMARK OFFICE

CERTIFICATE OF CORRECTION

PATENT NO. : 7,806,151 B2
APPLICATION NO. : 11/397333
DATED : October 5, 2010
INVENTOR(S) : Hennen et al.

It is certified that error appears in the above-identified patent and that said Letters Patent is hereby corrected as shown below:

Column 6, line 20:

"... member further including a rotatable valve conduit ..."

Should be:

-- ... member further including a valve conduit ... --

Signed and Sealed this
Twenty-third Day of October, 2012

David J. Kappos

David J. Kappos
*Director of the United States Patent and Trademark Office*